United States Patent [19]

Porat et al.

[11] Patent Number: 4,817,790

[45] Date of Patent: Apr. 4, 1989

[54] TOWELETTE

[76] Inventors: Amir Porat; Michael Porat, both of 2 Kaufman St., Tel Aviv, Israel

[21] Appl. No.: 25,074

[22] Filed: Mar. 12, 1987

[30] Foreign Application Priority Data

Apr. 22, 1986 [IL] Israel ..... 78566

[51] Int. Cl.[4] ..... B65D 81/22

[52] U.S. Cl. ..... 206/205; 206/210; 206/494; 206/812

[58] Field of Search ..... 15/104.93, 104.94; 206/229, 233, 209, 210, 205, 361, 362, 812; 53/435, 450

[56] References Cited

U.S. PATENT DOCUMENTS

| | | | |
|---|---|---|---|
| 3,240,326 | 3/1966 | Miller | 206/361 |
| 3,786,615 | 1/1974 | Bauer | 206/812 |
| 4,101,026 | 7/1978 | Bonk | 206/812 |
| 4,332,319 | 6/1982 | Hurwood | 206/210 |
| 4,575,891 | 3/1986 | Valente | 206/812 |

FOREIGN PATENT DOCUMENTS

| | | | |
|---|---|---|---|
| 2603085 | 8/1976 | Fed. Rep. of Germany | 206/812 |
| 2622571 | 12/1977 | Fed. Rep. of Germany . | |
| 2746098 | 4/1979 | Fed. Rep. of Germany . | |
| 2827909 | 1/1980 | Fed. Rep. of Germany . | |
| 0925043 | 5/1963 | United Kingdom | 15/104.93 |

*Primary Examiner*—Jimmy G. Foster

*Attorney, Agent, or Firm*—Dennison, Meserole, Pollack & Scheiner

[57] ABSTRACT

A moisturized towelette impregnated with wet powder, such as talc, which, after use on the skin and evaporation of the moisture therefrom, leaves a deposit of powder on the skin. Preferably, the towelette is made of a non-woven material, or paper, cotton, rayon, or a mixture of these materials or a woven material.

6 Claims, 1 Drawing Sheet

TOWELETTE

FIELD OF THE INVENTION

The present invention relates to moisturized towelettes in general and, in particular, to moisturized towelettes for applying talcum powder.

BACKGROUND OF THE INVENTION

After washing the body, particularly of babies and small children, it is often desired to provide a protective coating of powder to the skin. This is generally accomplished either by sprinkling the powder from a container directly onto the skin, or by means of a powder puff onto which the powder is poured and which is patted over the skin area.

It has now been discovered that the use of these methods of powdering the skin, particularly of babies, can be hazardous to their healths. This is due, principally, to two reasons, first, that inhalation of the cloud of powder which invariably accompanies the distribution of dry powder causes breathing difficulties and second, because inhalation of various body powders can cause cancer and other diseases.

There are known on the market a wide variety of pre-moisturized towelettes useful for cleaning the skin. These towelettes are marketed in sealable packages which prevent the evaporation of the moisture thereon until use.

There are also known a variety of aerosol cans including talc suspended in a liquid for use as spot removers from clothing. These aerosols have also been found to be hazardous to the health.

SUMMARY OF THE INVENTION

It is an object of the present invention to provide a towelette for applying powder to the skin which overcomes the disadvantages of the above-mentioned prior art.

There is thus provided in accordance with the present invention a moisturized towelette impregnated with wet powder which, after use on the skin and evaporation of the moisture therefrom, leaves a deposit of powder on the skin.

According to a preferred embodiment, the towelette is made of a non-woven material, or paper, cotton, rayon, or a mixture of materials or a woven material. Further according to a preferred embodiment, the wet powder includes talc.

There is further provided a package of moisturized towelettes including a sealable container, a plurality of separable moisturized towelettes disposed for individual removal within the sealable container, characterized in that the towelettes are impregnated with wet powder.

In addition there is provided a method for producing a towelette impregnated with wet powder including the steps of cutting a towelette, moistening the powder, and impregnating the towelette with the powder. The step of moistening may occur before, after or simultaneously with the step of impregnating.

There is also provided a method for applying a layer of powder to a surface including the steps of cutting a towelette, moistening the powder, impregnating the towelette with powder, passing the impregnated towelette over the surface, and permitting the moisture to evaporate from the surface leaving a deposit of powder thereon. The step of moistening may occur before, after or simultaneously with the step of impregnating.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
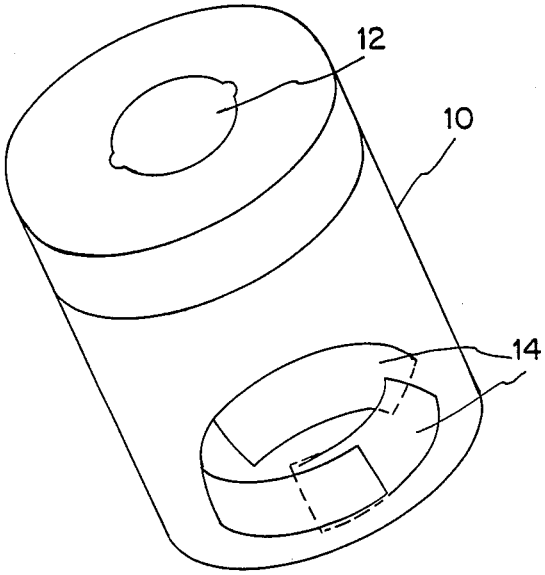
FIG. 1 is a perspective view of a package of moisturized towelettes constructed and operative in accordance with the present invention.

The present invention relates to a towelette impregnated with moisturized powder and a method of using such a towelette to apply a layer of powder to the skin. The towelette may comprise any suitable absorbent material, woven or non-woven, and most preferably comprises a non-woven material such as cotton, paper, rayon, or a mixture of these. Alternatively, the towelette may comprise any other conventional material which can absorb the wet powder and which will not irritate the skin during use. Alternatively, cotton balls or other similar articles may be used instead of towelettes.

The powder may comprise any body powder for cosmetic or bath use. It may comprise talcum powder (talc), so-called baby powder or any other conventional powder, preferably consisting of fine particles.

The moisturizing liquid may comprise any conventional liquid utilized in cleansing or refreshing the skin, including water, alcohol, oil or lotion, or any other conventional liquid, preferably including a volatile solvent which evaporates relatively rapidly upon exposure to air. Such liquids and combinations thereof are well known in the art.

The towelettes of the present invention may be produced by a number of methods. The general method is to cut a towelette of any desired size, to moisten the powder with the desired liquid and to impregnate the towelette with a small amount of the wet powder. The powder may be moistened before the towel is impregnated therewith, during impregnation, or after impregnation of the towel with the powder.

According to one embodiment of the invention, the towelette is first moistened by any conventional means and then the powder is sprinkled evenly over the surface thereof whereby the powder becomes wet and adheres to the towelette.

An alternate method according to the invention is to first sprinkle the towelette with an even layer of dry powder and then spray, or otherwise moisten, the towelette with the moisturizing liquid to wet the powder and cause it to adhere to the towelette. This may even be accomplished within the towelette packaging, by folding the towelettes therein, adding talc to the towelettes in the package, and then adding the liquid to the package. In the latter case, each towelette will act as a partial filter, retaining a portion of the wet powder and permitting the remainder to pass through to towelettes beneath or behind it. The package is then sealed until opened for use.

According to a third embodiment, the powder is first moistened in the liquid and then the towelette is impregnated with the wet powder. This can be accomplished, for example, by mixing the powder with the moistening liquid to form a suspension and either passing the towelette through the suspension or pouring the suspension over the towelette.

It will be appreciated that the ratio of powder to moisturizing fluid can vary greatly depending upon the amount of powder desired in the impregnated towelette. The only requirement is that the suspension remain liquid (i.e., not a paste). (In general, a relatively small amount of powder is all that is required.)

Figure 2:
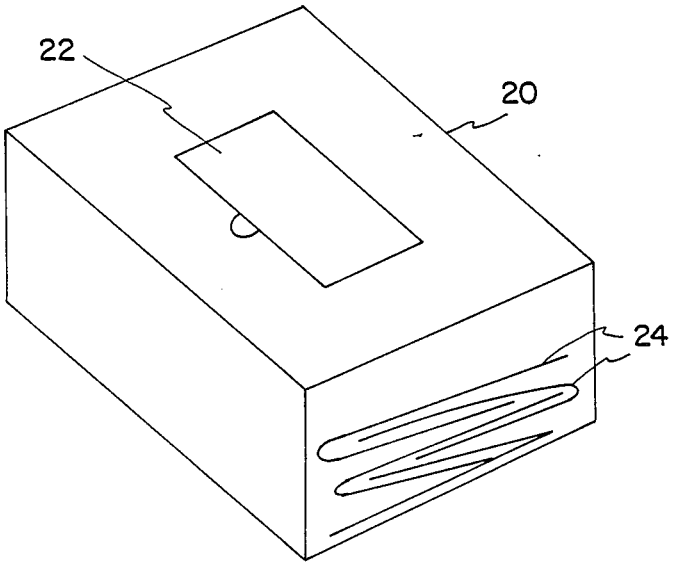
FIG. 2 is a perspective view of a package of moisturized towelettes constructed and operative in accordance with an alternate embodiment of the present invention.

The towelettes of the present invention are preferably packaged in resealable containers such as illustrated in FIGS. 1 and 2. In FIG. 1 there is shown a cylindrical package of moisturized towelettes including a casing 10. Casing 10 preferably consists of plastic, but it may alternately consist of any other material which prevents the evaporation of the moisture therein. Casing 10 defines a dispenser 12 through which one towelette at a time can be removed. Dispenser 12 is reclosable to permit opening for removal of a towelette and resealing to retain the moisture in the remaining towelettes.

A plurality of towelettes 14 are disposed in a spiral orientation within casing 10, as known. Towelettes 14 may comprise individual towelettes or a single sheet of material perforated at intervals along its length.

FIG. 2 illustrates an alternate package of impregnated towelettes comprising a rectangular casing 20, substantially as described with reference to casing 10, and including a reclosable dispenser 22. A plurality of towelettes 24 are disposed in casing 20 in accordian-fold orientation for ease of removal of individual towelettes.

Figure 3:
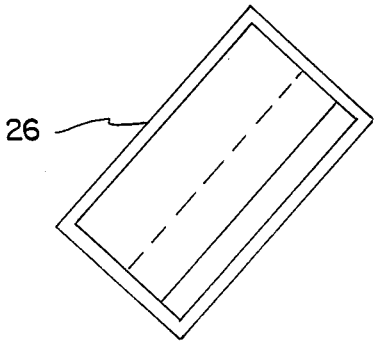
FIG. 3 is a perspective view of an individualized package for a single moisturized towelette constructed and operative in accordance with another alternate embodiment of the present invention.

It is also possible to package the towelettes individually for ease of carrying in handbags or for uses such as on airplanes. An individual packet is illustrated in FIG. 3. Such packet preferably includes a foil or plastic lined envelope 26 wherein a single folded towelette is disposed before sealing, as known in the art.

The method of applying powder to a surface, such as the body skin, is as follows. A towelette impregnated with wet powder as described hereinabove is passed over the skin. A film of powder in moisturizing liquid remains on the skin and, as the moisturizing liquid evaporates, a thin deposit of powder remains on the skin.

It is a particular feature of the present invention that the powder is applied to the skin while wet or damp. Thus, there are no clouds of powder suspended in the air to be inhaled by the person applying the powder or the person to whom it is being applied.

It will be appreciated by those skilled in the art that the invention is not limited to what has been shown and described hereinabove by way of example. Rather, the scope of the invention is limited solely by the claims which follow.

What is claimed is:

1. A package of towelettes comprising an openable and resealable container and at least two moisturized towelettes disposed within said container, wherein said at least two towelettes comprise a sheet of material impregnated with a powder to be deposited on the skin, together with a liquid carrier.

2. A package of towelettes according to claim 1 wherein said powder comprises talc.

3. A package of towelettes according to claim 2, wherein said at least two towelettes comprise a plurality of separable moisturized towelettes disposed for individual removal from within said resealable container.

4. A package of towelettes according to claim 1, wherein said at least two towelettes comprise a plurality of separable moisturized towelettes disposed for individual removal from within said resealable container.

5. A package of towelettes according to claim 1, wherein said liquid carrier is a volatile liquid.

6. A package of towelettes according to claim 1, wherein said liquid carrier comprises water.

* * * * *